US009792848B2

(12) United States Patent
Chen et al.

(10) Patent No.: US 9,792,848 B2
(45) Date of Patent: Oct. 17, 2017

(54) DIGITAL DRIVING METHOD OF OLED DISPLAY DEVICE

(71) Applicant: Shenzhen China Star Optoelectronics Technology Co., Ltd., Shenzhen (CN)

(72) Inventors: Mingfeng Chen, Shenzhen (CN); Chihhao Wu, Shenzhen (CN); Houliang Hu, Shenzhen (CN)

(73) Assignee: SHENZHEN CHINA STAR OPTOELECTRONICS TECHNOLOGY CO., Ltd., Shenzhen, Guangdong (CN)

( * ) Notice: Subject to any disclaimer, the term of this patent is extended or adjusted under 35 U.S.C. 154(b) by 85 days.

(21) Appl. No.: 14/892,206

(22) PCT Filed: Oct. 13, 2015

(86) PCT No.: PCT/CN2015/091799
§ 371 (c)(1),
(2) Date: Nov. 19, 2015

(87) PCT Pub. No.: WO2017/049675
PCT Pub. Date: Mar. 30, 2017

(65) Prior Publication Data

US 2017/0193902 A1 Jul. 6, 2017

(51) Int. Cl.
*G09G 3/20* (2006.01)
*G09G 3/3208* (2016.01)
(Continued)

(52) U.S. Cl.
CPC ..... *G09G 3/2022* (2013.01); *G09G 3/3208* (2013.01); *G09G 3/3225* (2013.01);
(Continued)

(58) Field of Classification Search
CPC ..... G09G 2310/02; G09G 5/003; G09G 2300/0842; G09G 2300/0861;
(Continued)

(56) References Cited

U.S. PATENT DOCUMENTS

2011/0164076 A1* 7/2011 Lee ..... G09G 3/3406 345/691
2012/0007848 A1* 1/2012 Han ..... G09G 3/3233 345/212
2014/0139505 A1* 5/2014 Han ..... H04N 13/0438 345/212

FOREIGN PATENT DOCUMENTS

CN 101140728 A 3/2008
CN 104809983 A 7/2015

* cited by examiner

*Primary Examiner* — Dmitriy Bolotin
(74) *Attorney, Agent, or Firm* — Leong C. Lei

(57) ABSTRACT

The present invention provides a digital driving method of an OLED display device, and the input front end data analysis module analyzes the data signals of at least two adjacent frames of image, and the OLED display device divides the data signals of each frame of image in the at least two adjacent frames of image into a plurality of subframes according to an order of display times, and adjusts an order of various color components outputted by the plurality of subframes corresponded with the data signals of each frame of image according to an analysis result of the data signals of at least two adjacent frames of image to prevent the new integral effect generates between the two adjacent frames of image because the data signals are different, and thus to eliminate the flicker and raising the image display quality.

15 Claims, 7 Drawing Sheets

(51) Int. Cl.
*G09G 3/3233* (2016.01)
*G09G 3/3225* (2016.01)

(52) U.S. Cl.
CPC ... *G09G 3/3233* (2013.01); *G09G 2300/0842* (2013.01); *G09G 2310/02* (2013.01)

(58) Field of Classification Search
CPC .... G09G 3/2014; G09G 3/2022–3/204; G09G 3/3233; G09G 3/32; G09G 3/3208; G09G 3/3225
See application file for complete search history.

DIGITAL DRIVING METHOD OF OLED DISPLAY DEVICE

FIELD OF THE INVENTION

The present invention relates to a display technology field, and more particularly to a digital driving method of an OLED display device.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED display device comprises a plurality of pixels aligned in array. The pixel drive circuit is utilized to drive the organic light emitting diode to emit light. The driving method of the OLED display device has the analog driving method and the digital driving method. When the analog driving method is used, it will easily happen that the driving currents of various pixels are different under the same driving data signal voltage and result in the Mura because the differences exist among the property parameters of the thin film transistor elements of different pixels. However, the digital driving method is used, the appearance of the Mura can be effectively suppressed.

FIG. 1 shows a 3T1C pixel driving circuit used for an OLED display device according to prior art, comprising: a first thin film transistor T1, a second thin film transistor T2, a third thin film transistor T3, a storage capacitor Cst and an organic light emitting diode OLED. The second thin film transistor T2 is a drive thin film transistor, and a gate and a source of the second thin film transistor T2 are respectively coupled to the first node A, the second node S, and the first thin film transistor T1 is employed to charge the first node A, i.e. the gate of the second thin film transistor T2, and the third thin film transistor T3 is employed to discharge the first node A, i.e. the gate of the second thin film transistor T2.

As performing digital driving to the aforesaid 3T1C pixel driving circuit used for the OLED display device, the first thin film transistor T1 charges the first node A, and the third thin film transistor T3 discharges the first node A, and thus, the first node A, i.e. the gate of the second thin film transistor T2 only outputs two Gamma voltage levels: the highest Gamma voltage (GM1) making the organic light emitting diode brightest, and the lowest Gamma voltage level (GM9) making the organic light emitting diode darkest. According the formula of calculating the current flowing through the organic light emitting diode OLED:

$$I=k(V_{GS}-V_{th})^2=k(V_A-V_S-V_{th})^2$$

wherein k is an intrinsic conductive factor of the drive thin film transistor, i.e. the second thin film transistor T2, and $V_{GS}$ is a gate-source voltage of the second thin film transistor T2, and $V_{th}$ is a threshold voltage of the second thin film transistor T2, and $V_A$ is the voltage of the first node A, i.e. a gate voltage of the second thin film transistor T2, and $V_S$ is a voltage of the second node S, i.e. a source voltage of the second thin film transistor T2.

The voltage $V_A$ of the first node A making the organic light emitting diode brightest is the highest Gamma voltage (GM1), and the degeneration or the inconsistency of the thin film transistor elements result in that the variation of the threshold voltage $V_{th}$ is smaller relative to the variation of $(V_A-V_s)$. In comparison with the analog driving method, the digital driving method can suppress the Mura of the OLED display device.

With that the first thin film transistor T1 charges the first node A, and the third thin film transistor T3 discharges the first node A, the first node A is ultimately controlled to output only two Gamma voltage levels. The OLED display device performs the brightness modulation with a way similar to the Pulse-Width Modulation (PWM) for cutting the gray scales. As shown in FIG. 2, driving the 6 bits OLED display device is illustrated. Each frame of image is divided into six Sub frames according to an order of display times. By controlling the charge, discharge times of the Sub frames with combination of the sense of the human eyes to the brightness, which is the integration principle in time. Two Gamma voltages (i.e. GM1 and GM 9) can be utilized to show the images of various gray scale brightnesses and to control the color components outputted by various Sub frames. As shown in FIG. 2, the output order of the color components from the first Sub frame to the sixth Sub frame is from bit6 to bit1, wherein the gray scale corresponded with the color component bit6 is the highest, and the gray scale corresponded with the color component bit1 is the lowest.

FIG. 3 shows that in the digital driving method according to prior art, the diagram that the 6 bits OLED display device continuously shows a plurality of frames of image. Each frame of image is divided into six Sub frames, and the corresponding times of all the Sub frames are equal. The output orders of the color components of each frame of image are the same. As shown in FIG. 3, all the output order of the color components from the first Sub frame to the sixth Sub frame of the (N−1)th, the Nth and the (N+1)th frames of image are bit6 to bit1.

The advantage of the driving method is that the sizes of the six Sub frames corresponded with each frame of image are the same, and the color components are outputted in the same order. The driving is easy to be achieved. The shortcoming is that the different integral effects generate to the two adjacent frames of images because the data signals are different. For example, the color component bit3, the color component bit2 and the color component bit1 respectively outputted by the fourth Sub frame to the sixth Sub frame in the (N−1)th frame of image will generate new integral effects, which are different from the color component bit6, the color component bit5 and the color component bit4 respectively outputted by the first Sub frame to the third Sub frame in the Nth frame of image because the data signals are different. Accordingly, the image flicker occurs and the gray scales in sequence show ladder reforms, and the display effect is not right.

SUMMARY OF THE INVENTION

An objective of the present invention is to provide a digital driving method of an OLED display device capable of eliminating the image flicker and raising the image display quality.

For realizing the aforesaid objective, the present invention provides a digital driving method of an OLED display device, comprising steps of:

step 1, providing an OLED display device, and the OLED display device comprises a plurality of pixels aligned in array, and each pixel comprises a pixel driving circuit, and the pixel driving circuit comprises: a first thin film transistor, a second thin film transistor, a third thin film transistor, a storage capacitor and an organic light emitting diode;

the second thin film transistor is employed to drive the organic light emitting diode, and the first thin film transistor is employed to charge a gate of the second thin film transistor, and the third thin film transistor is employed to discharge the gate of the second thin film transistor to make the gate of the second thin film transistor only at a highest or a lowest Gamma voltage level;

step 2, providing data signals of at least two adjacent frames of image to an input front end data analysis module, and the input front end data analysis module analyzes the data signals of at least two adjacent frames of image;

step 3, the OLED display device divides the data signals of each frame of image in the at least two adjacent frames of image into a plurality of subframes according to an order of display times, and adjusts an order of various color components outputted by the plurality of subframes corresponded with the data signals of each frame of image according to an analysis result of the data signals of at least two adjacent frames of image to eliminate flicker.

A gate of the first thin film transistor receives a scan drive signal, and a source receives a data signal, and a drain is electrically coupled to a first node; a gate of the second thin film transistor is electrically coupled to the first node, and a source is electrically coupled to a second node, and a drain receives a power source positive voltage; a gate of the third thin film transistor receives a discharge control signal, and a source is electrically coupled to the first node, and a drain receives a constant reference voltage level; one end of storage capacitor is electrically coupled to the first node, and the other end is electrically coupled to the drain of the second thin film transistor; an anode of the organic light emitting diode is electrically coupled to the second node, and a cathode receives a power source negative voltage.

The display times of the plurality of subframes of each frame of image are equal or different.

Each time that each subframe is charged and discharged, the OLED display device adjusts the output order of various color components by controlling charge, discharge times of the respective subframes to the second thin film transistors in all the pixels.

The input front end data analysis module analyzes a change of the data signals in the at least two adjacent frames of image to obtain the analysis result.

The plurality of subframes corresponded with one single frame outputs the various colors components with an order or no order; the input front end data analysis module determines whether the output orders of the color components of former, latter two adjacent frames of image are the same or different according to the analysis result of the data signals of the former, latter two adjacent frames of image.

The constant reference voltage level is 0 or a negative voltage level close to 0.

An amount of the plurality of subframes corresponded with the data signal of each frame of image is not limited; an total light output is unchanged before and after the order of the various color components outputted by the plurality of subframes corresponded with the data signal of each frame of image.

Selectably, in the step 1, the OLED display device provides a 6 bits, and in the step 3, the data signal of each frame of image in the at least two adjacent frames of image is divided into six subframes according to the order of display times, and the various color components comprise a first color component, a second color component, a third color component, a fourth color component, a fifth color component and a sixth color component.

Selectably, in the step 1, the OLED display device provides an 8 bits, and in the step 3, the data signal of each frame of image in the at least two adjacent frames of image is divided into eight subframes according to the order of display times, and the various color components comprise a first color component, a second color component, a third color component, a fourth color component, a fifth color component, a sixth color component, a seventh color component and an eighth color component.

The present invention further provides a digital driving method of an OLED display device, comprising steps of:

step 1, providing an OLED display device, and the OLED display device comprises a plurality of pixels aligned in array, and each pixel comprises a pixel driving circuit, and the pixel driving circuit comprises: a first thin film transistor, a second thin film transistor, a third thin film transistor, a storage capacitor and an organic light emitting diode;

the second thin film transistor is employed to drive the organic light emitting diode, and the first thin film transistor is employed to charge a gate of the second thin film transistor, and the third thin film transistor is employed to discharge the gate of the second thin film transistor to make the gate of the second thin film transistor only at a highest or a lowest Gamma voltage level;

step 2, providing data signals of at least two adjacent frames of image to an input front end data analysis module, and the input front end data analysis module analyzes the data signals of at least two adjacent frames of image;

step 3, the OLED display device divides the data signals of each frame of image in the at least two adjacent frames of image into a plurality of subframes according to an order of display times, and adjusts an order of various colors outputted by the plurality of subframes corresponded with the data signals of each frame of image according to an analysis result of the data signals of at least two adjacent frames of image to eliminate flicker;

wherein a gate of the first thin film transistor receives a scan drive signal, and a source receives a data signal, and a drain is electrically coupled to a first node; a gate of the second thin film transistor is electrically coupled to the first node, and a source is electrically coupled to a second node, and a drain receives a power source positive voltage; a gate of the third thin film transistor receives a discharge control signal, and a source is electrically coupled to the first node, and a drain receives a constant reference voltage level; one end of storage capacitor is electrically coupled to the first node, and the other end is electrically coupled to the drain of the second thin film transistor; an anode of the organic light emitting diode is electrically coupled to the second node, and a cathode receives a power source negative voltage;

wherein the display times of the plurality of subframes of each frame of image are equal or different;

wherein each time that each subframe is charged and discharged, the OLED display device adjusts the output order of various color components by controlling charge, discharge times of the respective subframes to the second thin film transistors in all the pixels;

wherein the input front end data analysis module analyzes a change of the data signals in the at least two adjacent frames of image to obtain the analysis result;

wherein an amount of the plurality of subframes corresponded with the data signal of each frame of image is not limited; a total light output is unchanged before and after the order of the various color components outputted by the plurality of subframes corresponded with the data signal of each frame of image.

The benefits of the present invention are: in the digital driving method of the OLED display device provided by the present invention, the input front end data analysis module analyzes the data signals of at least two adjacent frames of image, and the OLED display device divides the data signals of each frame of image in the at least two adjacent frames of image into a plurality of subframes according to an order of display times, and adjusts an order of various color components outputted by the plurality of subframes corresponded with the data signals of each frame of image according to an analysis result of the data signals of at least two adjacent frames of image to prevent the new integral effect generates between the two adjacent frames of image because the data signals are different, and thus to eliminate the flicker and raising the image display quality.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
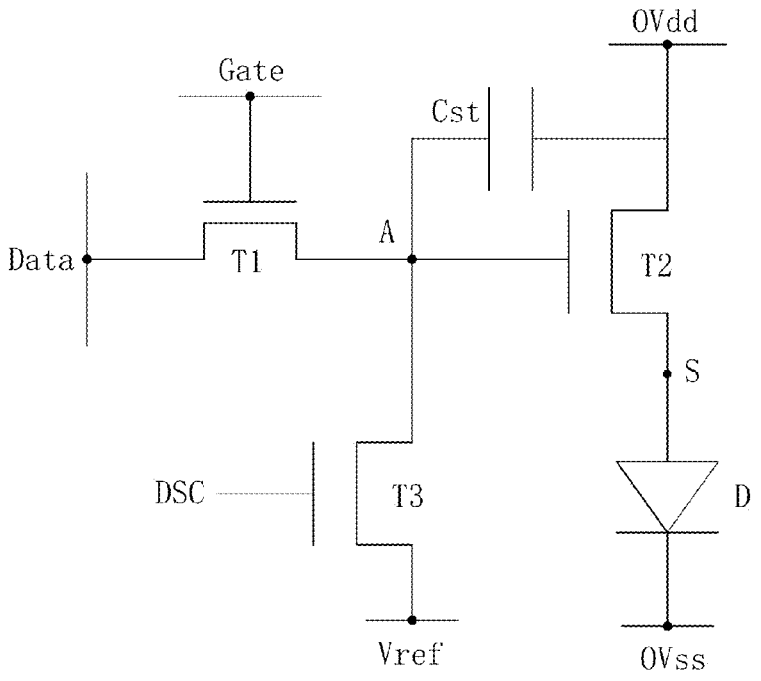
FIG. 1 is a diagram of an OLED pixel driving circuit according to prior art.
Figure 2:
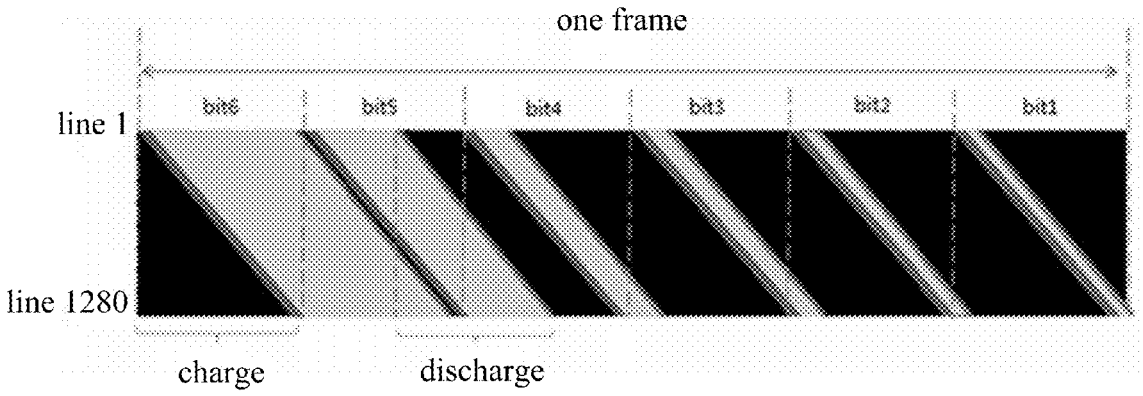
FIG. 2 is a diagram of an output order of color components when a 6 bits OLED display device shows a frame of image according to a digital driving method of an OLED display device according to prior art.
Figure 3:
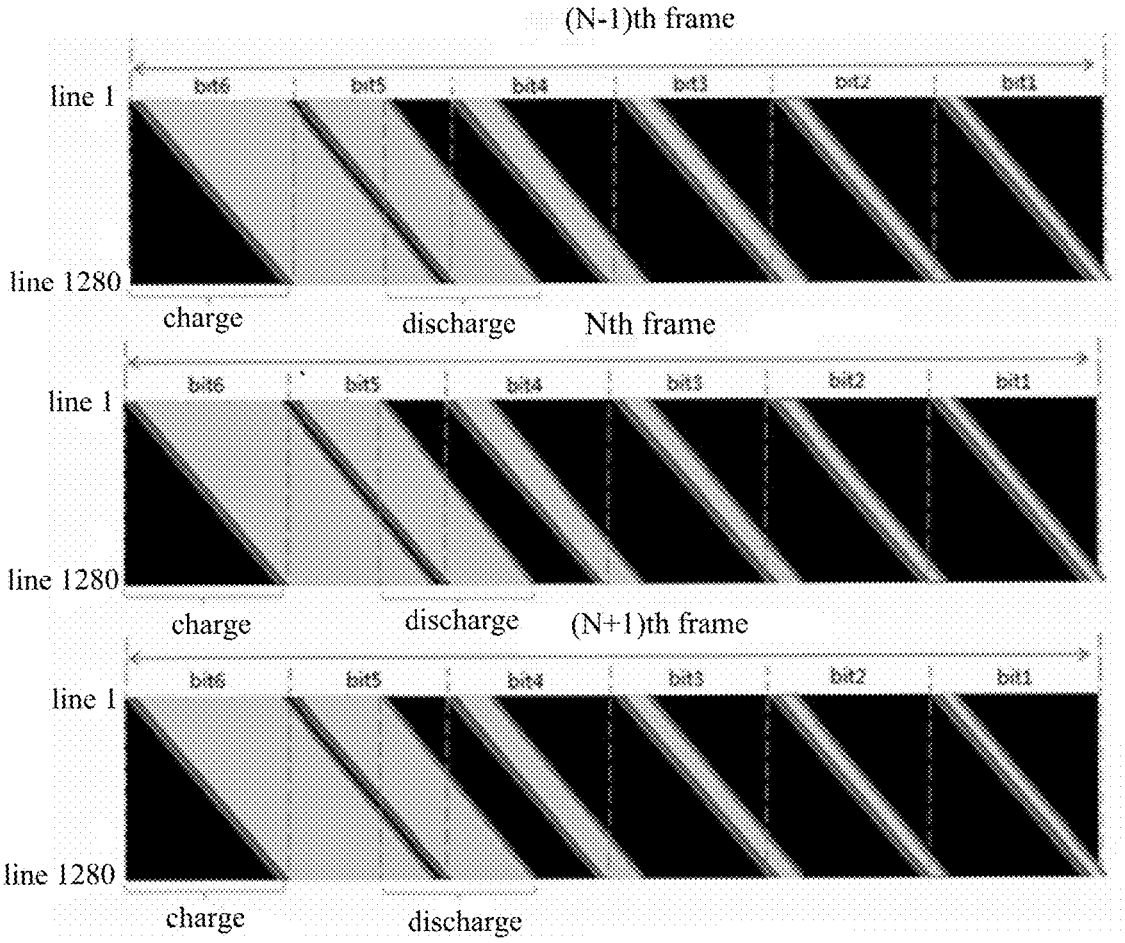
FIG. 3 is a diagram of an output order of color components when a 6 bits OLED display device continuously shows a plurality of frames of image according to a digital driving method of an OLED display device according to prior art.
Figure 4:
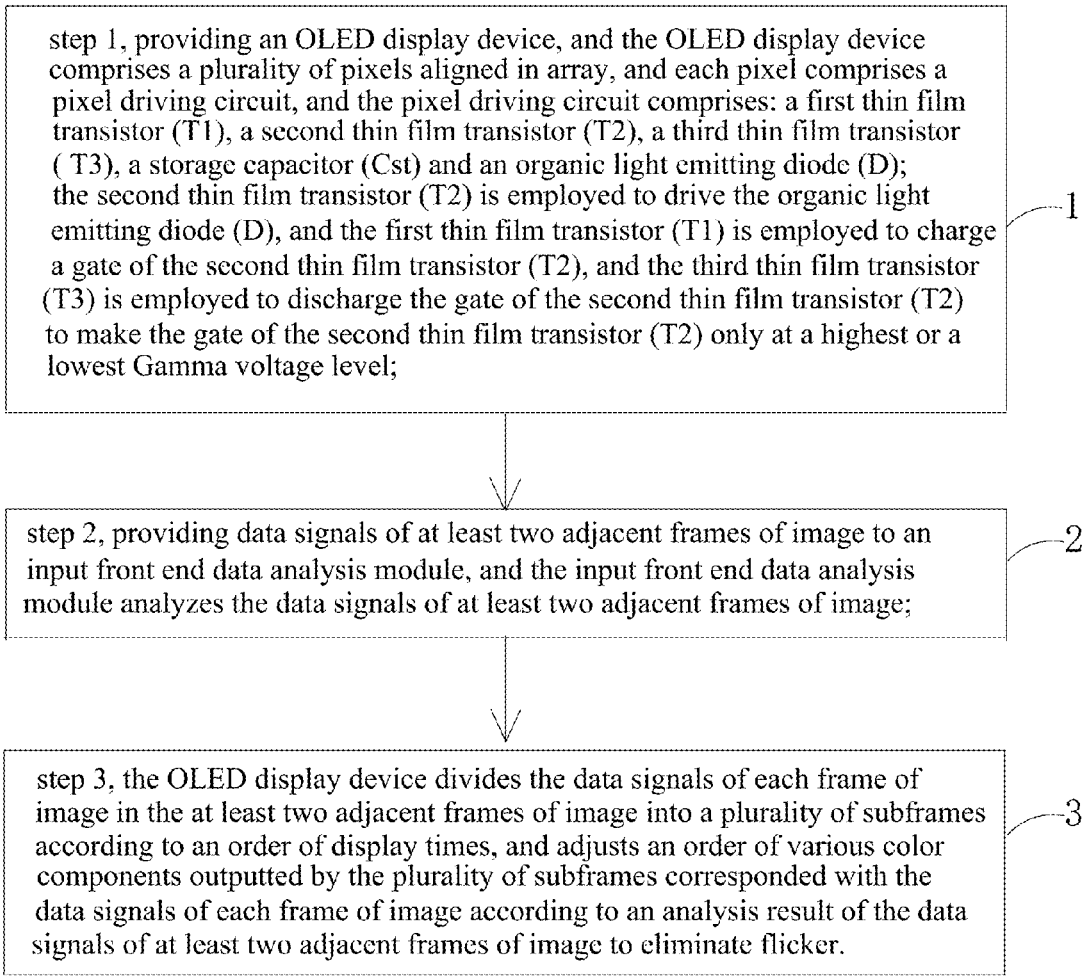
FIG. 4 is a flowchart of a digital driving method of an OLED display device according to the present invention.

Please refer to FIG. 4. The present invention provides a digital driving method of an OLED display device, comprising steps of:

step 1, providing an OLED display device, and the OLED display device comprises a plurality of pixels aligned in array, and each pixel comprises a pixel driving circuit. As shown in FIG. 1, the pixel driving circuit comprises: a first thin film transistor T1, a second thin film transistor T2, a third thin film transistor T3, a storage capacitor Cst and an organic light emitting diode D.

Specifically, a gate of the first thin film transistor T1 receives a scan drive signal Gate, and a source receives a data signal Data, and a drain is electrically coupled to a first node A; a gate of the second thin film transistor T2 is electrically coupled to the first node A, and a source is electrically coupled to a second node S, and a drain receives a power source positive voltage OVdd; a gate of the third thin film transistor T3 receives a discharge control signal DSC, and a source is electrically coupled to the first node A, and a drain receives a constant reference voltage level Vref; the constant reference voltage level is 0 or a negative voltage level close to 0; one end of storage capacitor Cst is electrically coupled to the first node A, and the other end is electrically coupled to the drain of the second thin film transistor T2; an anode of the organic light emitting diode D is electrically coupled to the second node S, and a cathode receives a power source negative voltage OVss.

The second thin film transistor T2 is employed to drive the organic light emitting diode D, and the first thin film transistor T1 is employed to charge a gate of the second thin film transistor T2, i.e. the first node A, and the third thin film transistor T3 is employed to discharge the gate of the second thin film transistor T2, i.e. the first node A to make the gate of the second thin film transistor T2, i.e. the first node A only at a highest or a lowest Gamma voltage level, and when the first node A is at the highest Gamma voltage (GM1), the organic light emitting diode D is brightest, and when the first node A is at the highest Gamma voltage (GM1), organic light emitting diode D is darkest.

Furthermore, the OLED display device provided in the step 1 can be a 6 bits OLED display device. The 6 bits means that the level that the OLED display device is capable of showing the gray scales is 2 of the sixth power, i.e. 64 levels of gray scales; the OLED display device provided in the step 1 also can be an 8 bits OLED display device. The 8 bits means that the level that the OLED display device is capable of showing the gray scales is 2 of the eighth power, i.e. 256 levels of gray scales.

step 2, providing data signals of at least two adjacent frames of image to an input front end data analysis module, and the input front end data analysis module analyzes the data signals of at least two adjacent frames of image.

Specifically, the input front end data analysis module analyzes a change of the data signals in the at least two adjacent frames of image to obtain the analysis result.

step 3, the OLED display device divides the data signals of each frame of image in the at least two adjacent frames of image into a plurality of subframes according to an order of display times, and adjusts an order of various color components outputted by the plurality of subframes corresponded with the data signals of each frame of image according to an analysis result of the data signals of at least two adjacent frames of image to eliminate flicker.

Specifically, the OLED display device performs the brightness modulation with a way similar to the PWM.

The display times of the plurality of subframes of each frame of image are equal or different. Each time that each subframe is charged and discharged, the OLED display device adjusts the output order of various color components by controlling charge, discharge times of the respective subframes to the second thin film transistors T2 in all the pixels.

The plurality of subframes corresponded with one single frame outputs the various colors components with an order or no order.

The input front end data analysis module determines whether the output orders of the color components of former, latter two adjacent frames of image are the same or different according to the analysis result of the data signals of the former, latter two adjacent frames of image.

An amount of the plurality of subframes corresponded with the data signal of each frame of image is not limited.

A total light output is unchanged before and after the order of the various color components outputted by the plurality of subframes corresponded with the data signal of each frame of image.

Furthermore, for the 6 bits OLED display device, in the step 3, the data signal of each frame of image in the at least two adjacent frames of image is divided into six subframes according to the order of display times, and the various color components comprise a first color component bit1, a second color component bit2, a third color component bit3, a fourth color component bit4, a fifth color component bit5 and a sixth color component bit6, wherein the gray scale level corresponded with the sixth color component bit6 is the highest, and the gray scale level corresponded with the first color component bit1 is the lowest. Furthermore, for the 8 bits OLED display device, in the step 3, the data signal of each frame of image in the at least two adjacent frames of image is divided into eight subframes according to the order of display times, and the various color components comprise a first color component bit1, a second color component bit2, a third color component bit3, a fourth color component bit4, a fifth color component bit5, a sixth color component bit6, a seventh color component bit7 and an eighth color component bit8, wherein the gray scale level corresponded with the eighth color component bit8 is the highest, and the gray scale level corresponded with the first color component bit1 is the lowest.

Figure 5:
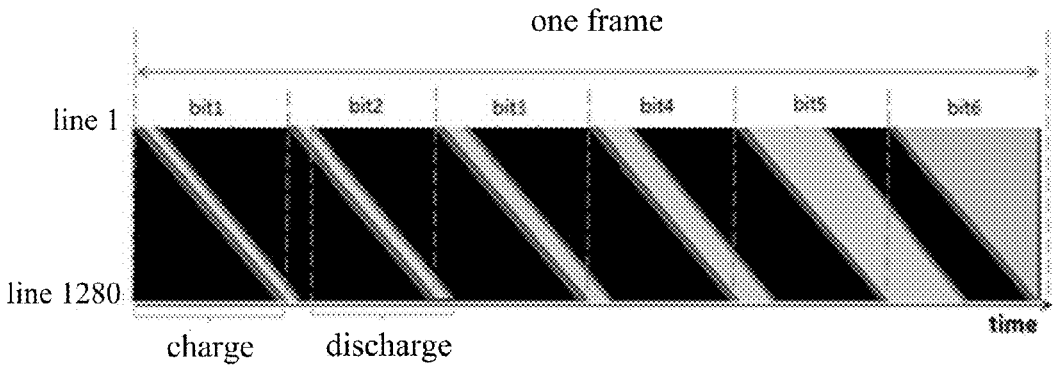
FIG. 5 shows the first embodiment of an output order of color components when a 6 bits OLED display device shows a frame of image according to a digital driving method of an OLED display device according to the present invention.
Figure 6:
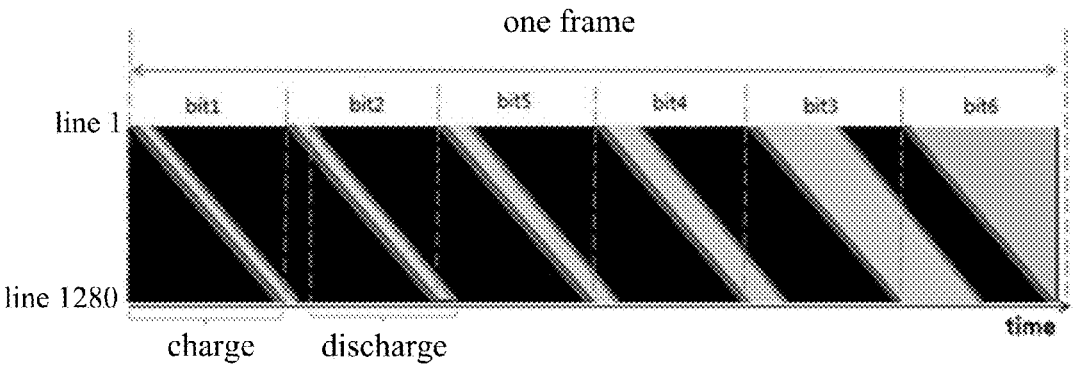
FIG. 6 shows the second embodiment of an output order of color components when a 6 bits OLED display device shows a frame of image according to a digital driving method of an OLED display device according to the present invention.
Figure 7:
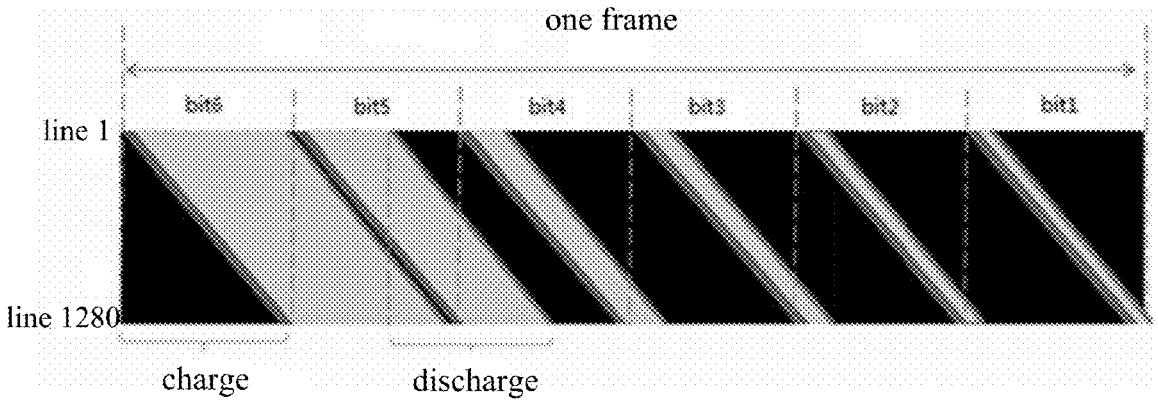
FIG. 7 shows the third embodiment of an output order of color components when a 6 bits OLED display device shows a frame of image according to a digital driving method of an OLED display device according to the present invention.

The 6 bits OLED display device is illustrated. The OLED display device adjusts an order of various color components outputted by the plurality of subframes corresponded with the data signals of each frame of image according to an analysis result of the data signals of at least two adjacent frames of image by the input front end data analysis module, the output order of the color components as showing one frame of image can be shown in FIG. 5: the first subframe outputs the first color component bit1, and the second subframe outputs the second color component bit2, and the third subframe outputs the third color component bit3, and the fourth subframe outputs the fourth color component bit4, and the fifth subframe outputs the fifth color component bit5, and the sixth subframe outputs the sixth color component bit6. In other words, the color components are outputted in an order of bit1, bit2, bit3, bit4, bit5, bit6; the output order of the color components as showing one frame of image also can be shown in FIG. 6: the first subframe outputs the first color component bit1, and the second subframe outputs the second color component bit2, and the third subframe outputs the fifth color component bit5, and the fourth subframe outputs the fourth color component bit4, and the fifth subframe outputs the third color component bit3, and the sixth subframe outputs the sixth color component bit6. In other words, the color components are outputted in an order of bit1, bit2, bit5, bit4, bit3, bit6; the output order of the color components as showing one frame of image also can be shown in FIG. 7: the first subframe outputs the sixth color component bit6, and the second subframe outputs the fifth color component bit5, and the third subframe outputs the fourth color component bit4, and the fourth subframe outputs the third color component bit3, and the fifth subframe outputs the second color component bit2, and the sixth subframe outputs the first color component bit1. In other words, the color components are outputted in an order of bit6, bit5, bit4, bit3, bit2, bit1. FIG. 5, FIG. 6 and FIG. 7 merely show the three embodiments of the output orders of the color components in one frame of image. Certainly, the output order of the color components in one frame of image is not limited to these three embodiments.

The 8 bits OLED display device is illustrated. The color components in one frame of image can be outputted in an order of bit8, bit7, bit6, bit5, bit4, bit3, bit2, bit1 (not shown), and the color components in one frame of image also can be outputted in an order of bit7, bit8, bit1, bit2, bit3, bit4, bit5, bit6 or other orders (not shown).

Figure 8:
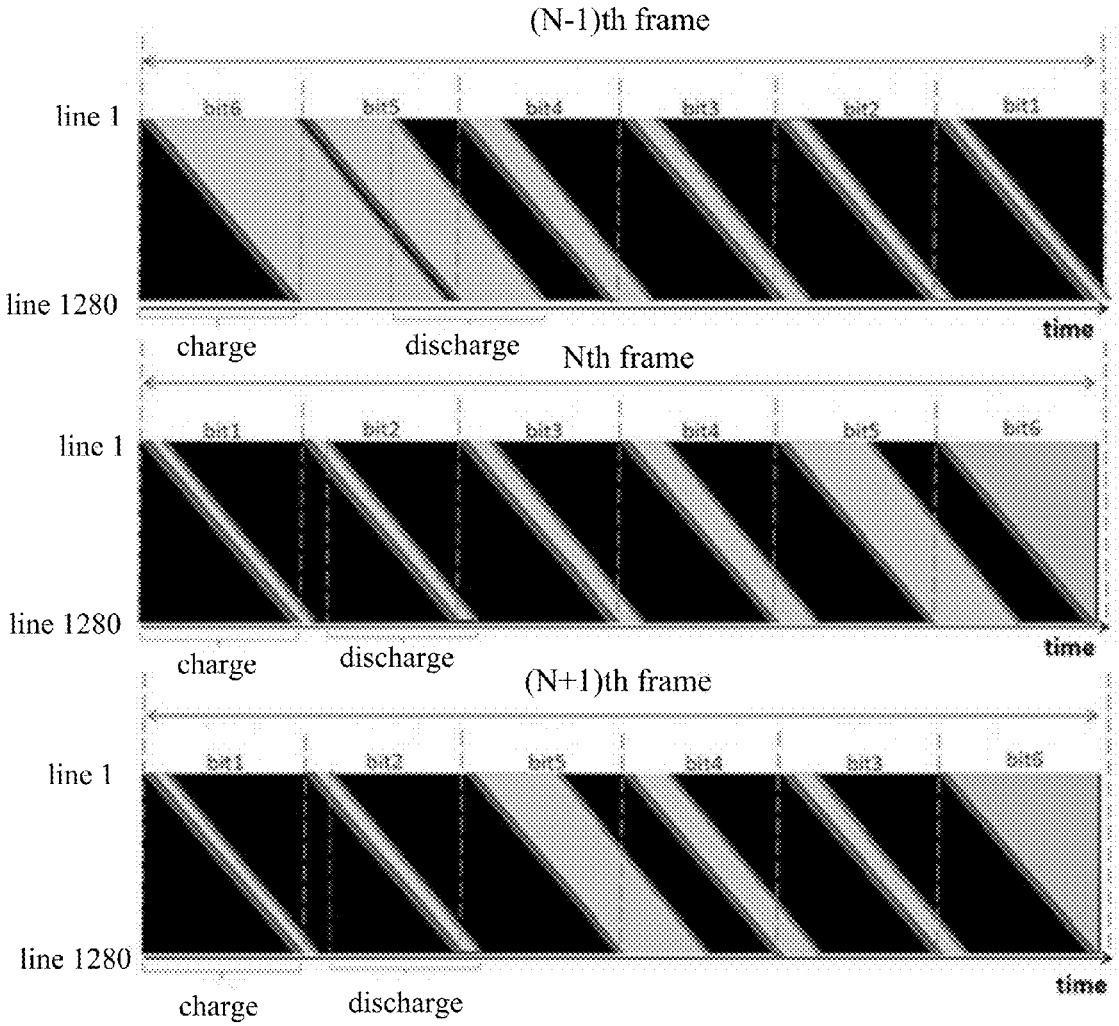
FIG. 8 shows an embodiment of an output order of color components when a 6 bits OLED display device continuously shows a plurality of frames of image according to a digital driving method of an OLED display device according to the present invention.
Figure 9:
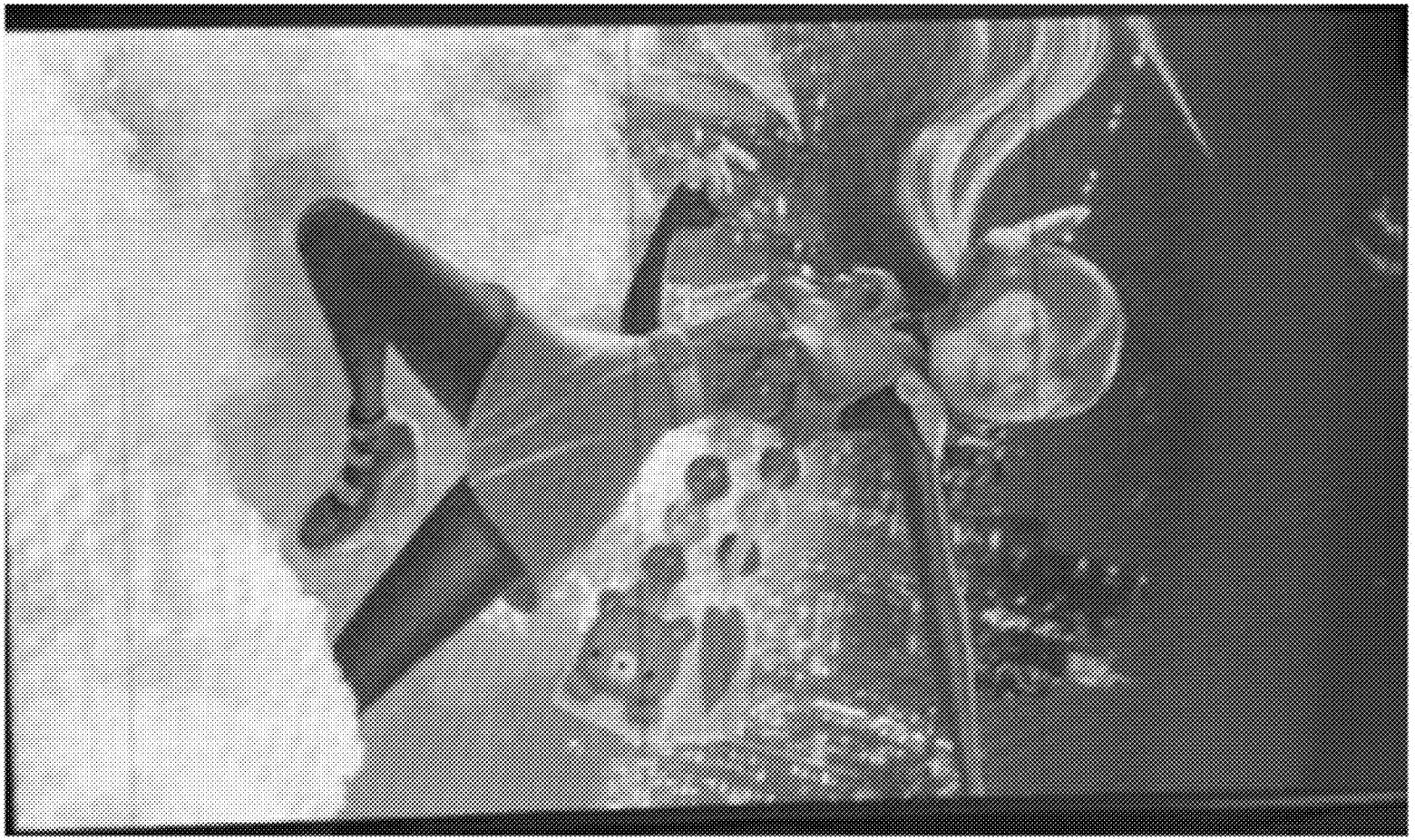
FIG. 9 is an image display result diagram that the digital driving method of the OLED display device according to the present invention is not utilized for driving.
Figure 10:
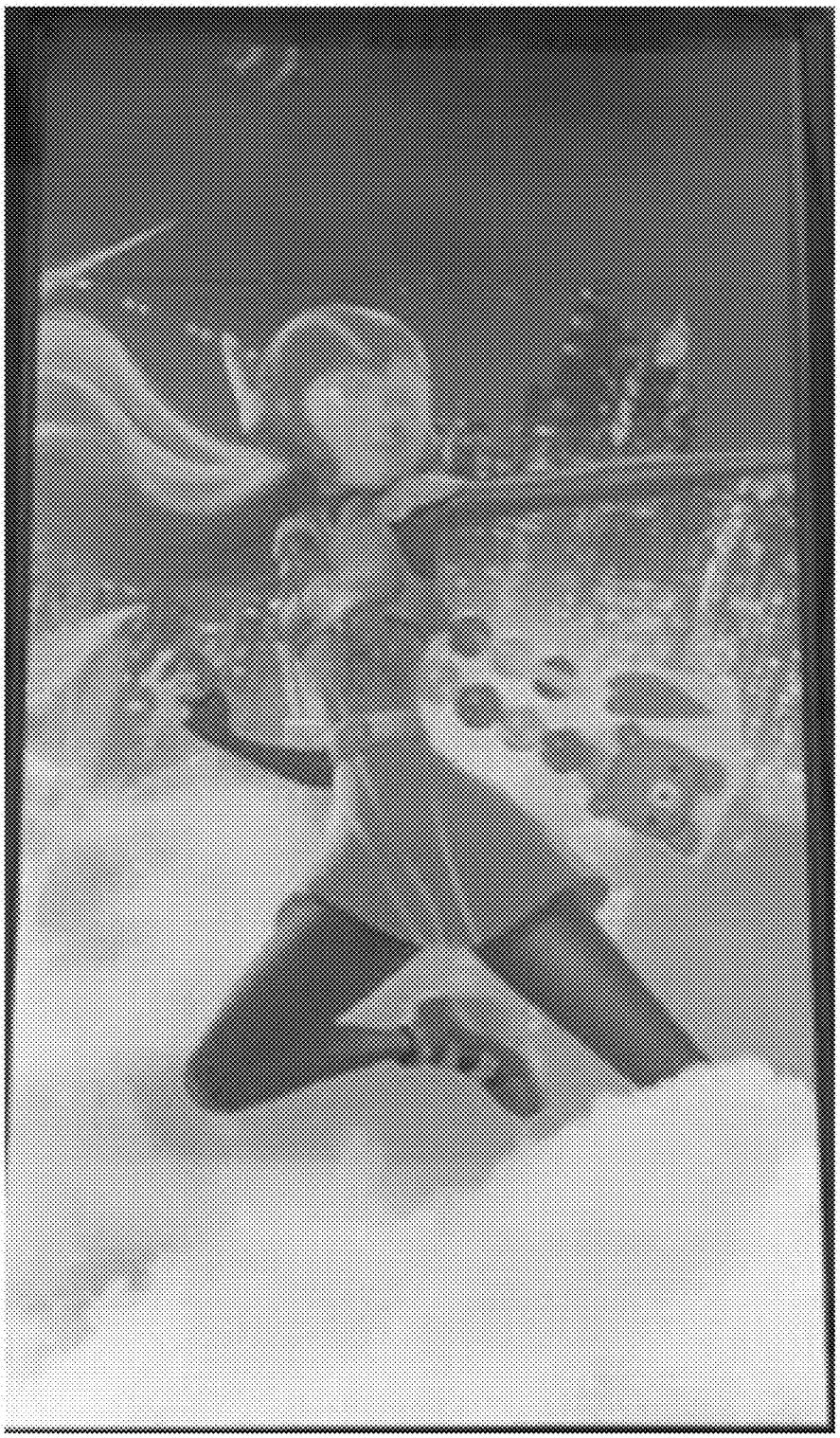
FIG. 10 is an image display result diagram that the digital driving method of the OLED display device according to the present invention is utilized for driving.

FIG. 8 shows an output order of color components when the 6 bits OLED display device continuously shows a plurality of frames of image according to the digital driving method of the OLED display device according to the present invention: the color components in the (N−1)th frame of image are outputted in an order of bit6, bit5, bit4, bit3, bit2, bit1, and the color components in the Nth frame of image are outputted in an order of bit1, bit2, bit3, bit4, bit5, bit6, and the color components in the (N+1)th frame of image are outputted in an order of bit1, bit2, bit3, bit4, bit5, bit6. Namely, the output orders of color components of every two adjacent frames of image are different, and it is different from prior art, in which each frame of image outputs color components in the same order to prevent the new integral effect generates between the two adjacent frames of image because the data signals are different, and thus to eliminate the flicker and raising the image display quality. As being told by comparing FIG. 9 and FIG. 10, by utilizing the digital driving method of the OLED display device according to the present invention for driving, the image flickers is basically eliminated, and display effect is better.

Significantly, the digital driving method of the OLED display device according to the present invention also can be applied for driving other digital driving display devices.

In conclusion, in the digital driving method of the OLED display device of the present invention, the input front end data analysis module analyzes the data signals of at least two adjacent frames of image, and the OLED display device divides the data signals of each frame of image in the at least two adjacent frames of image into a plurality of subframes according to an order of display times, and adjusts an order of various color components outputted by the plurality of subframes corresponded with the data signals of each frame of image according to an analysis result of the data signals of at least two adjacent frames of image to prevent the new integral effect generates between the two adjacent frames of image because the data signals are different, and thus to eliminate the flicker and raising the image display quality.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A digital driving method of an OLED display device, comprising steps of:

step 1, providing an OLED display device, and the OLED display device comprises a plurality of pixels aligned in array, and each pixel comprises a pixel driving circuit, and the pixel driving circuit comprises: a first thin film transistor, a second thin film transistor, a third thin film transistor, a storage capacitor and an organic light emitting diode;

the second thin film transistor is employed to drive the organic light emitting diode, and the first thin film transistor is employed to charge a gate of the second thin film transistor, and the third thin film transistor is employed to discharge the gate of the second thin film transistor to make the gate of the second thin film transistor only at a highest or a lowest Gamma voltage level;

step 2, providing data signals of at least two adjacent frames of image to an input front end data analysis module, and the input front end data analysis module analyzes the data signals of at least two adjacent frames of image;

step 3, the OLED display device divides the data signals of each frame of image in the at least two adjacent frames of image into a plurality of subframes according to an order of display times, and adjusts an order of various color components outputted by the plurality of subframes corresponded with the data signals of each frame of image according to an analysis result of the data signals of at least two adjacent frames of image to eliminate flicker.

2. The digital driving method of an OLED display device according to claim 1, wherein a gate of the first thin film transistor receives a scan drive signal, and a source receives a data signal, and a drain is electrically coupled to a first node; a gate of the second thin film transistor is electrically coupled to the first node, and a source is electrically coupled to a second node, and a drain receives a power source positive voltage; a gate of the third thin film transistor receives a discharge control signal, and a source is electrically coupled to the first node, and a drain receives a constant reference voltage level; one end of storage capacitor is electrically coupled to the first node, and the other end is electrically coupled to the drain of the second thin film transistor; an anode of the organic light emitting diode is electrically coupled to the second node, and a cathode receives a power source negative voltage.

3. The digital driving method of an OLED display device according to claim 2, wherein the constant reference voltage level is 0 or a negative voltage level close to 0.

4. The digital driving method of an OLED display device according to claim 1, wherein the display times of the plurality of subframes of each frame of image are equal or different.

5. The digital driving method of an OLED display device according to claim 1, wherein each time that each subframe is charged and discharged, the OLED display device adjusts the output order of various color components by controlling charge, discharge times of the respective subframes to the second thin film transistors in all the pixels.

6. The digital driving method of an OLED display device according to claim 1, wherein the input front end data analysis module analyzes a change of the data signals in the at least two adjacent frames of image to obtain the analysis result.

7. The digital driving method of an OLED display device according to claim 6, wherein the plurality of subframes corresponded with one single frame outputs the various colors components with an order or no order; the input front end data analysis module determines whether the output orders of the color components of former, latter two adjacent frames of image are the same or different according to the analysis result of the data signals of the former, latter two adjacent frames of image.

8. The digital driving method of an OLED display device according to claim 1, wherein an amount of the plurality of subframes corresponded with the data signal of each frame of image is not limited; an total light output is unchanged before and after the order of the various color components outputted by the plurality of subframes corresponded with the data signal of each frame of image.

9. The digital driving method of an OLED display device according to claim 8, wherein in the step 1, the OLED display device provides a 6 bits, and in the step 3, the data signal of each frame of image in the at least two adjacent frames of image is divided into six subframes according to the order of display times, and the various color components comprise a first color component, a second color component, a third color component, a fourth color component, a fifth color component and a sixth color component.

10. The digital driving method of an OLED display device according to claim 8, wherein in the step 1, the OLED display device provides an 8 bits, and in the step 3, the data signal of each frame of image in the at least two adjacent frames of image is divided into eight subframes according to the order of display times, and the various color components comprise a first color component, a second color component, a third color component, a fourth color component, a fifth color component, a sixth color component, a seventh color component and an eighth color component.

11. A digital driving method of an OLED display device, comprising steps of:

step 1, providing an OLED display device, and the OLED display device comprises a plurality of pixels aligned in array, and each pixel comprises a pixel driving circuit, and the pixel driving circuit comprises: a first thin film transistor, a second thin film transistor, a third thin film transistor, a storage capacitor and an organic light emitting diode;

the second thin film transistor is employed to drive the organic light emitting diode, and the first thin film transistor is employed to charge a gate of the second thin film transistor, and the third thin film transistor is employed to discharge the gate of the second thin film transistor to make the gate of the second thin film transistor only at a highest or a lowest Gamma voltage level;

step 2, providing data signals of at least two adjacent frames of image to an input front end data analysis module, and the input front end data analysis module analyzes the data signals of at least two adjacent frames of image;

step 3, the OLED display device divides the data signals of each frame of image in the at least two adjacent frames of image into a plurality of subframes according to an order of display times, and adjusts an order of various colors outputted by the plurality of subframes corresponded with the data signals of each frame of image according to an analysis result of the data signals of at least two adjacent frames of image to eliminate flicker;

wherein a gate of the first thin film transistor receives a scan drive signal, and a source receives a data signal, and a drain is electrically coupled to a first node; a gate of the second thin film transistor is electrically coupled to the first node, and a source is electrically coupled to a second node, and a drain receives a power source positive voltage; a gate of the third thin film transistor receives a discharge control signal, and a source is electrically coupled to the first node, and a drain receives a constant reference voltage level; one end of storage capacitor is electrically coupled to the first node, and the other end is electrically coupled to the drain of the second thin film transistor; an anode of the organic light emitting diode is electrically coupled to the second node, and a cathode receives a power source negative voltage;

wherein the display times of the plurality of subframes of each frame of image are equal or different;

wherein each time that each subframe is charged and discharged, the OLED display device adjusts the output order of various color components by controlling charge, discharge times of the respective subframes to the second thin film transistors in all the pixels;

wherein the input front end data analysis module analyzes a change of the data signals in the at least two adjacent frames of image to obtain the analysis result;

wherein an amount of the plurality of subframes corresponded with the data signal of each frame of image is not limited; a total light output is unchanged before and after the order of the various color components outputted by the plurality of subframes corresponded with the data signal of each frame of image.

12. The digital driving method of an OLED display device according to claim 11, wherein the plurality of subframes corresponded with one single frame outputs the various colors components with an order or no order; the input front end data analysis module determines whether the output orders of the color components of former, latter two adjacent frames of image are the same or different according to the analysis result of the data signals of the former, latter two adjacent frames of image.

13. The digital driving method of an OLED display device according to claim 11, wherein the constant reference voltage level is 0 or a negative voltage level close to 0.

14. The digital driving method of an OLED display device according to claim 11, wherein in the step 1, the OLED display device provides a 6 bits, and in the step 3, the data signal of each frame of image in the at least two adjacent frames of image is divided into six subframes according to the order of display times, and the various color components comprise a first color component, a second color component, a third color component, a fourth color component, a fifth color component and a sixth color component.

15. The digital driving method of an OLED display device according to claim 11, wherein in the step 1, the OLED display device provides an 8 bits, and in the step 3, the data signal of each frame of image in the at least two adjacent frames of image is divided into eight subframes according to the order of display times, and the various color components comprise a first color component, a second color component, a third color component, a fourth color component, a fifth color component, a sixth color component, a seventh color component and an eighth color component.

* * * * *